US010619554B2

(12) United States Patent
Takagi et al.

(10) Patent No.: US 10,619,554 B2
(45) Date of Patent: Apr. 14, 2020

(54) ENGINE COOLING APPARATUS

(71) Applicant: TOYOTA JIDOSHA KABUSHIKI KAISHA, Toyota-shi, Aichi-ken (JP)

(72) Inventors: Noboru Takagi, Toyota (JP); Masaaki Yamaguchi, Obazaki (JP); Rihito Kaneko, Miyoshi (JP); Hirokazu Ando, Seto (JP); Mitsuru Yamaguchi, Ama (JP); Yoshihiro Furuya, Toyota (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 16/129,180

(22) Filed: Sep. 12, 2018

(65) Prior Publication Data

US 2019/0093546 A1 Mar. 28, 2019

(30) Foreign Application Priority Data

Sep. 25, 2017 (JP) ..... 2017-183611

(51) Int. Cl.

| | |
|---|---|
| ***F01P 7/16*** | (2006.01) |
| *F01P 5/12* | (2006.01) |
| *F01P 7/14* | (2006.01) |

(52) U.S. Cl.

CPC ..... *F01P 7/164* (2013.01); *F01P 7/167* (2013.01); *F01P 2005/125* (2013.01);
(Continued)

(58) Field of Classification Search

CPC .... F01P 7/16; F01P 7/164; F01P 7/165; F01P 7/167; F01P 2007/146; F01P 2005/125;
(Continued)

(56) References Cited

U.S. PATENT DOCUMENTS 6,568,356 B1 * 5/2003 Hayakawa ..... F01P 7/167 123/41.1
6,684,826 B2 * 2/2004 Yoshikawa ..... F01P 7/167 123/41.1

(Continued)

FOREIGN PATENT DOCUMENTS

| | | |
|---|---|---|
| JP | 2007-100638 | 4/2007 |
| JP | 2013-124656 | 6/2013 |
| JP | 2016-003578 | 1/2016 |

*Primary Examiner* — Grant Moubry
(74) *Attorney, Agent, or Firm* — Finnegan, Henderson, Farabow, Garrett & Dunner, LLP

(57) ABSTRACT

A coolant circuit of an engine cooling apparatus includes a first passage where coolant flows through a radiator and a second passage where coolant flows without passing through the radiator. A coolant control valve controls a first passage flow rate Frad and a second passage flow rate Fsec. An outlet coolant temperature sensor detects an outlet coolant temperature Tout, which is a coolant temperature before a branching point of the first passage and the second passage. An inlet coolant temperature sensor detects an inlet coolant temperature Tin, which is a coolant temperature after a merging point of the first passage and the second passage. A coolant temperature estimator calculates a radiator coolant temperature Trad, which is a coolant temperature at a coolant exit of the radiator, when the first passage flow rate Frad is greater than or equal to a specified flow rate using equation (1).

$$Trad = Tin - (Tout - Tin) \times \frac{Fsec}{Frad} \quad (1)$$

5 Claims, 4 Drawing Sheets

(52) U.S. Cl.
CPC ..... *F01P 2007/146* (2013.01); *F01P 2025/30* (2013.01); *F01P 2025/32* (2013.01); *F01P 2060/04* (2013.01)

(58) Field of Classification Search
CPC . F01P 2025/30; F01P 2025/32; F01P 2060/04
See application file for complete search history.

(56) References Cited

U.S. PATENT DOCUMENTS

| | | | | |
|---|---|---|---|---|
| 6,857,398 | B2 * | 2/2005 | Takagi | F01P 7/167 123/41.1 |
| 9,404,410 | B2 * | 8/2016 | Nishikawa | F01P 7/04 |
| 10,054,033 | B2 * | 8/2018 | Watanabe | F01P 5/12 |
| 10,174,664 | B2 * | 1/2019 | Toyama | F01P 11/16 |
| 2018/0080366 | A1 * | 3/2018 | Toyama | B60H 1/08 |
| 2018/0087452 | A1 * | 3/2018 | Bidner | B60H 1/3208 |

* cited by examiner

ENGINE COOLING APPARATUS

BACKGROUND ART

The present invention relates to an engine cooling apparatus.

As described in Japanese Laid-Open Patent Publication 2013-124656, a known engine cooling apparatus includes a coolant circuit and a coolant control valve. The coolant circuit includes a passage that extends through a radiator and another passage that does not extend through the radiator. The passages are arranged parallel to one another. The coolant control valve sets the flow rate ratio of coolant in each passage to be variable. In such an engine cooling apparatus, increasing and decreasing the flow rate ratio of the coolant flowing through the radiator adjusts the temperature of the coolant that flows into the engine.

In the engine cooling apparatus, a coolant temperature sensor may be configured to check the temperature of the coolant only outside the radiator. In such a configuration, when the flow rate ratio of the coolant passing through the radiator remains zero or at an extremely small value for a long period in a state in which the outside temperature is low, the coolant in the radiator will be cooled by the outside air. Thus, the coolant temperature detected by the coolant temperature sensor may greatly differ from the coolant temperature in the radiator. When the flow rate ratio of the coolant flowing in the radiator is increased under such a condition, thermal strain may occur to reduce the durability of the radiator. Further, an increase in the flow rate ratio of the coolant will suddenly send the cold coolant that was remaining in the radiator out of the radiator. This may excessively lower the temperature of the coolant flowing into the engine. In the engine cooling apparatus, of which the flow rate ratio of the coolant flowing in the radiator is variable, it is desirable that the temperature of the coolant in the radiator be checked in addition to that of the coolant circulating through the coolant circuit. However, the arrangement of an exclusive sensor that detects the coolant temperature in the radiator will raise costs.

SUMMARY OF THE INVENTION

One object of the present invention is to provide an engine cooling apparatus that allows the temperature of the coolant in the radiator to be checked without directly measuring the temperature.

An engine cooling apparatus that achieves the above object includes a coolant circuit, a coolant control valve, an outlet coolant temperature sensor, an inlet coolant temperature sensor, and a coolant temperature estimator. The coolant circuit recirculates coolant that has passed through an engine back to the engine. The coolant circuit includes a first passage, which allows coolant to flow through a radiator, and a second passage, which allows coolant to flow without passing through the radiator, arranged parallel to the first passage. The coolant control valve controls a first passage flow rate Frad, which is a flow rate of the coolant flowing through the first passage, and a second passage flow rate Fsec, which is a flow rate of the coolant flowing through the second passage. The outlet coolant temperature sensor detects an outlet coolant temperature Tout, which is a temperature of the coolant before the coolant reaches a branching point of the first passage and the second passage in the coolant circuit. The inlet coolant temperature sensor detects an inlet coolant temperature Tin, which is a temperature of the coolant after the coolant has passed through a merging point of the first passage and the second passage in the coolant circuit. When a radiator coolant temperature Trad is a temperature of the coolant at a coolant exit of the radiator, the coolant temperature estimator calculates the radiator coolant temperature Trad when the first passage flow rate Frad is greater than or equal to a specified flow rate. The radiator coolant temperature Trad relative to the first passage flow rate Frad, the second passage flow rate Fsec, the outlet coolant temperature Tout, and the inlet coolant temperature Tin satisfies equation (1).

$$Trad = Tin - (Tout - Tin) \times \frac{Fsec}{Frad} \tag{1}$$

In the engine cooling apparatus, the coolant flowing through the coolant circuit is branched into coolant flowing through the first passage and coolant flowing through the second passage in the coolant circuit. Then, the coolant flowing through the first passage merges with the coolant flowing through the second passage before entering the engine. The coolant flowing into the merging point of the two passages from the first passage is referred to as a first passage coolant, and the coolant flowing into the merging point from the second passage is referred to as a second passage coolant. When the temperature of the first passage coolant differs from the temperature of the second passage coolant, heat is exchanged between the first passage coolant and the second passage coolant after merging with each other. The quantity of heat the first passage coolant receives from the second passage coolant is equal to the quantity of heat the second passage coolant receives from the first passage coolant. Further, the temperature of the first passage coolant is substantially equal to the temperature (radiator coolant temperature Trad) of the coolant at an outlet of the radiator. Thus, from the relationship of the quantity of heat Q and the temperature change ΔT (Q=ΔT×mass×specific heat), equation (2) is derived. Equation (2) shows the relationship of the quantity of heat exchanged between the first passage coolant and the second passage coolant. In equation (2), "Tsec" represents the temperature of the second passage coolant.

$$(Tsec - Tin) \times Fsec = (Tin - Trad) \times Frad \tag{2}$$

In comparison with the temperature difference (=Tout−Trad) between the outlet coolant temperature Tout and the radiator coolant temperature Trad of the first passage coolant, which is cooled in the radiator, the temperature difference (=Tout−Tsec) between the outlet coolant temperature Tout and the second passage coolant Tsec is subtle. Thus, even when the temperature of the second passage coolant Tsec is considered as being the same as the outlet coolant temperature Tout, the relationship of equation (2) is substantially satisfied. In the above equation (1), the temperature Tsec of equation (2) is substituted for the outlet coolant temperature Tout to obtain the radiator coolant temperature Trad.

When the flow rate of the coolant flowing through the first passage is such that the temperature of the coolant affects the inlet coolant temperature Tin, the radiator coolant temperature Trad can be estimated by calculating the radiator coolant temperature Trad so that the relationship of the radiator coolant temperature Trad relative to the first passage flow rate Frad, the second passage flow rate Fsec, the outlet coolant temperature Tout, and the inlet coolant temperature Tin satisfies equation (1).

When the first passage flow rate Frad is small and the temperature of the coolant flowing into the merging point from the first passage hardly affects the inlet coolant temperature Tin, the radiator coolant temperature Trad approaches the outside temperature as time elapses. In this case, the radiator coolant temperature Trad converges to the outside temperature more quickly as the velocity of the air blown against the radiator becomes higher. In this regard, when a value of the radiator coolant temperature Trad calculated immediately before the first passage flow rate Frad becomes less than the specified flow rate is an initial coolant temperature, the coolant temperature estimator in the engine cooling apparatus calculates, based on the initial coolant temperature and the outside temperature, the radiator coolant temperature Trad when the first passage flow rate Frad is less than the specified flow rate as a value that varies with a first-order lag element from the initial coolant temperature to the outside temperature in accordance with the time elapsed from when the first passage flow rate Frad becomes less than the specified flow rate. Further, the coolant temperature estimator sets a time constant of the first-order lag element to a smaller value when the velocity of air current blown against the radiator is high than when the velocity is low. When an electric fan or the like is not forcibly blowing air toward the radiator, the speed of the vehicle, in which the engine is installed, determines the velocity of the air current blown against the radiator. Thus, in this case, the time constant is set based on the speed of the vehicle, in which the engine is installed, to be a smaller value when the speed is high than when the speed is low.

In a state in which the radiator coolant temperature Trad is low, when the flow rate of the coolant flowing through the first passage rapidly increases, thermal strain may occur in the radiator. The rapid increase in the first passage flow rate may also cause a rapid decrease in the temperature of the coolant flowing into the engine. Thus, the engine cooling apparatus includes a controller that controls actuation of the coolant control valve. When increasing the flow rate of the coolant flowing through the first passage, the controller sets the actuation speed of the coolant control valve to be lower when the radiator coolant temperature Trad estimated by the coolant temperature estimator is low than when the radiator coolant temperature Trad is high.

Further, the estimation of the radiator coolant temperature Trad from the above equation (1) is based on the presumption that the temperature of the coolant flowing into the merging point from the second passage is substantially equal to the outlet coolant temperature Tout. In contrast, immediately after the engine has been started, cold coolant may be remaining in the second passage. Consequently, the remaining coolant will flow into the merging point immediately after the coolant begins to flow through the second passage. This would impede accurate calculation of the radiator coolant temperature Trad. Thus, in the engine cooling apparatus, when initiating circulation of coolant through the coolant circuit after the engine is started, the coolant begins to flow sequentially in order of the second passage and then, after a delay, the first passage.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF PREFERRED EMBODIMENTS

An engine cooling apparatus in accordance with one embodiment will now be described in detail with reference to FIGS. 1 to 6. The engine cooling apparatus of the present embodiment is applied to a vehicle engine.

Figure 1:
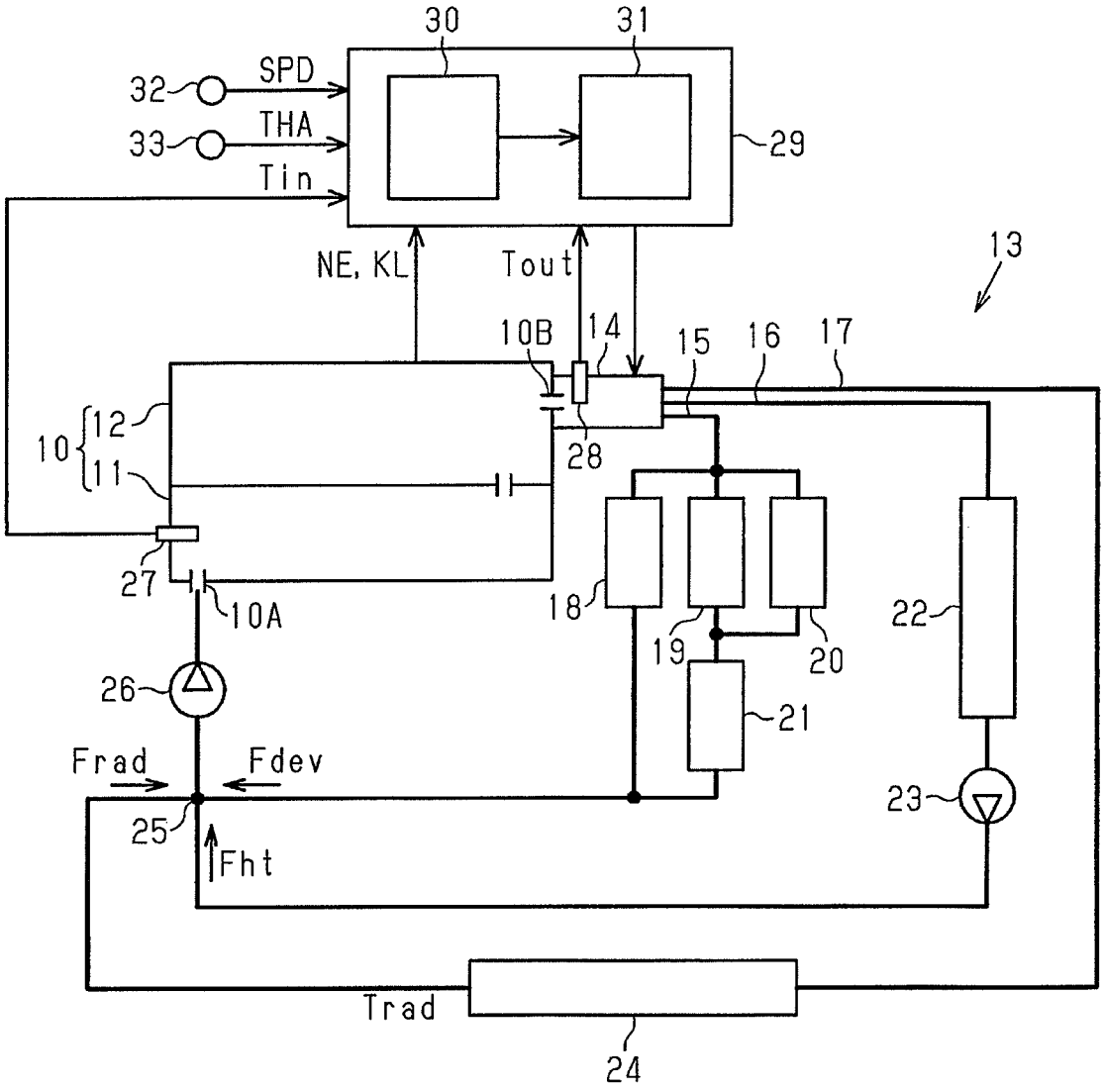
FIG. 1 is a schematic diagram of an engine cooling apparatus in accordance with a first embodiment.

As shown in FIG. 1, the engine cooling apparatus of the present embodiment includes a coolant circuit 13 to, recirculate coolant that has passed through an engine 10 back to the engine 10. The coolant circuit 13 allows coolant to flow from an outlet 10B in a cylinder head 12 to an inlet 10A in a cylinder block 11.

A coolant control valve 14 is arranged in the part of the coolant circuit 13 that connects the coolant circuit 13 to the outlet 10B. The coolant circuit 13 branches off at the coolant control valve 14 into three passages, namely, a device passage 15, a heater passage 16, and a radiator passage 17.

The device passage 15 is configured to allow coolant to flow through a throttle valve 18, an exhaust gas recirculation (EGR) valve 19, an EGR cooler 20, and an oil cooler 21. Further, the heater passage 16 is configured to allow coolant to flow through a heater core 22, and the radiator passage 17 is configured to allow coolant to flow through a radiator 24. The three passages 15 to 17 merge at a merging point 25. In the present embodiment, the radiator passage 17 serves as a first passage that is arranged in the coolant circuit 13 and allows coolant to flow through the radiator 24. Further, the device passage 15 and the heater passage 16 serve as a second passage that is arranged parallel to the first passage in the coolant circuit 13 and allows coolant to flow without passing through the radiator 24. In the present embodiment, the coolant control valve 14 is a branching point of the first passage and the second passage in the coolant circuit 13.

A mechanical water pump 26 is arranged between the merging point 25 and the inlet 10A in the coolant circuit 13. The mechanical water pump 26, which is actuated by the output of the engine 10, circulates coolant through the engine 10 and the coolant circuit 13. In addition to the mechanical water pump 26, the engine cooling apparatus of the present embodiment includes an electric water pump 23 that is arranged in the heater passage 16. When the engine stops running and the mechanical water pump 26 is deactuated, the electric water pump 23 continues to supply coolant to the heater core 22.

An inlet coolant temperature sensor 27 is arranged in the cylinder block 11 near the inlet 10A to detect an inlet coolant temperature Tin that is the temperature of the coolant immediately after the coolant has entered the engine 10. Further, an outlet coolant temperature sensor 28 is arranged in the coolant control valve 14 to detect an outlet coolant temperature Tout that is the temperature of the coolant immediately after the coolant has passed through the engine 10. The inlet coolant temperature Tin in this case corresponds to the temperature of the coolant that has passed the merging point 25 of the first passage (radiator passage 17) and the second passage (device passage 15, heater passage 16) in the coolant circuit 13. Further, the outlet coolant temperature Tout corresponds to the temperature of the coolant before reaching the branching point of the first passage and the second passage in the coolant circuit 13.

The engine cooling apparatus of the present embodiment further includes an electronic control unit 29. In addition to the detection results of the inlet coolant temperature Tin and the outlet coolant temperature Tout, the vehicle speed SPD detected by a speed sensor 32 and the outside temperature THA detected by an outside temperature sensor 33 are input to the electronic control unit 29. Other information that indicates the driving state of the engine 10 such as the engine rotation speed NE and the engine load factor KL are also input to the electronic control unit 29.

The electronic control unit 29 in the engine cooling apparatus of the present embodiment controls the flow of coolant in the coolant circuit 13 with the coolant control valve 14. The electronic control unit 29 includes, as a structure related to the control of the coolant control valve 14, a coolant temperature estimator 30 and a coolant control valve (CCV) controller 31. The coolant temperature estimator 30 executes a process for estimating the coolant temperature at a radiator outlet of the radiator 24 (radiator coolant temperature Trad). The CCV controller 31 executes a process for controlling the drive voltage of the coolant control valve 14.

The coolant control valve 14 will now be described in detail. The coolant control valve 14 includes three ports, namely, a device port connected to the device passage 15, a heater port connected to the heater passage 16, and a radiator port connected to the radiator passage 17. The ports serve as discharge ports and discharge the coolant that has entered the coolant control valve 14 from the outlet 10B in the cylinder head 12. Further, a rotatable valve element and a motor that rotates the valve element are incorporated in the coolant control valve 14. The coolant control valve 14 is configured to change an opening area of each discharge port based on the valve element rotated by the motor.

The present embodiment employs a brushed DC motor as the motor of the coolant control valve 14. Rotation direction of the brushed DC motor is reversed when the current direction of the motor is inverted. In the description hereafter, a rotation direction of the valve element when the current direction of the motor is set to a predetermined direction will be referred to as the positive direction. Further, a rotation direction of the valve element when the current direction of the motor is set opposite to the predetermined direction will be referred to as the negative direction.

Figure 2:
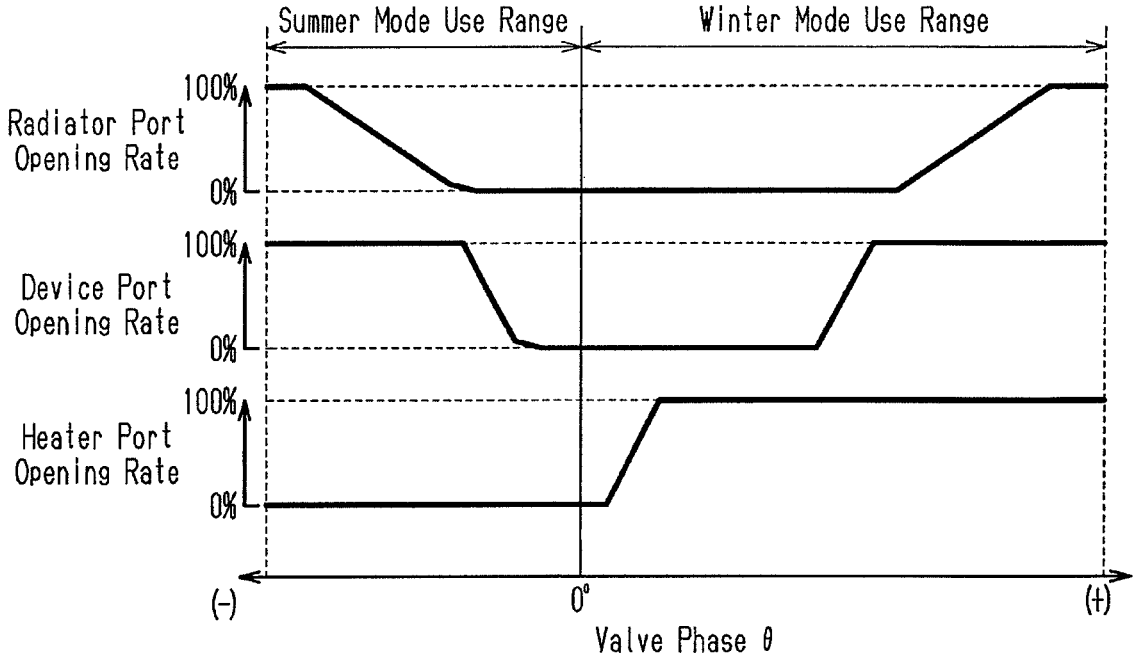
FIG. 2 is a graph showing the relationship between the valve phase of a coolant control valve arranged in the engine cooling apparatus of FIG. 1 and the opening rate of each discharge port.

FIG. 2 illustrates the relationship between a valve phase θ of the valve element and the opening rate of each discharge port in the coolant control valve 14. The valve phase θ is "0°" at a position where the valve element closes all three discharge ports and represents the rotation angle of the valve element from the position where the valve phase θ is 0° in the positive direction and the negative direction. The opening rate represents the ratio of the opening area of each discharge port and is "100%" when the discharge port is fully open.

As shown in FIG. 2, the opening rate of each discharge port is set to be changed based on the valve phase θ of the valve element. The range of the valve phase θ that extends in the positive direction from the position where the valve phase θ is 0° is the range of the valve phase θ used when heating the passenger compartment (winter mode use range). The range of the valve phase θ that extends in the negative direction from the position where the valve phase θ is 0° is the range of the valve phase θ used when not heating the passenger compartment (summer mode use range).

When the valve element is rotated in the positive direction from the position where the valve phase θ is 0°, the heater port first begins to open and the opening rate of the heater port gradually increases as the valve phase θ increases in the positive direction. Consequently, after the heater port is fully open, that is, after the opening rate of the heater port reaches 100%, the device port begins to open and the opening rate of the device port gradually increases as the valve phase θ increases in the positive direction. Then, after the device port is fully open, that is, after the opening rate of the device port reaches 100%, the radiator port begins to open and the opening rate of the radiator port gradually increases as the valve phase θ increases in the positive direction and ultimately reaches 100%.

In contrast, when the valve element is rotated in the negative direction from the position where the valve phase θ is 0°, the device port first begins to open and the opening rate of the device port gradually increases as the valve phase θ increases in the negative direction. The radiator port begins to open slightly before the device port fully opens, that is, at a position located slightly before reaching the position corresponding to where the opening rate of the device port is 100%. Consequently, the opening rate of the radiator port gradually increases as the valve phase θ increases in the negative direction and ultimately reaches 100%. When the valve phase θ is in the summer mode use range, which extends in the negative direction from the position where the valve phase θ is 0°, the heater port is always fully closed.

In the coolant control valve 14, the direction in which the valve phase θ changes is switched based on the direction of the current flowing in the motor, and the speed of changes in the valve phase θ change is varied based on the voltage applied to the motor (hereafter, referred to as the drive voltage Eccv). When the valve phase θ of the coolant control valve 14 is changed, the flow rate ratio of the coolant flowing in each of the three passages 15 to 17 accordingly changes.

Estimation of Radiator Coolant Temperature

The process for estimating the radiator coolant temperature Trad executed by the coolant temperature estimator 30 will now be described.

In the engine cooling apparatus of the present embodiment, the coolant flowing through the radiator passage 17 and the coolant flowing through the device passage 15 and the heater passage 16 merge at the merging point 25 and flow into the engine 10. When the flow rate of the coolant flowing in the radiator passage 17 (radiator flow rate Frad) is zero or an extremely small value, the radiator coolant temperature Trad hardly affects the inlet coolant temperature Tin detected by the inlet coolant temperature sensor 27. The coolant temperature estimator 30 estimates the radiator coolant temperature Trad through one mode when the radiator flow rate Frad is too small for the radiator coolant temperature Trad to affect the inlet coolant temperature Tin. The coolant temperature estimator 30 estimates the radiator coolant temperature Trad through another mode when the radiator flow rate Frad is such that the radiator coolant temperature Trad affects the inlet coolant temperature Tin. Hereafter, a state in which the radiator flow rate Frad is too small for the radiator coolant temperature Trad to affect the inlet coolant temperature Tin will indicate that the radiator port is closed. A state in which the radiator flow rate Frad is such that the radiator coolant temperature Trad affects the inlet coolant temperature. Tin will indicate that the radiator port is open.

The coolant temperature estimator 30 determines that the radiator port is open when the radiator flow rate Frad is greater than or equal to the specified flow rate α, and determines that the radiator port is closed when the radiator flow rate Frad is less than the specified flow rate α. The total flow rate of the coolant circulating through the coolant circuit 13 is determined by the flow rate of the coolant discharged from the mechanical water pump 26, and the flow rate of the coolant discharged from the mechanical water pump 26 is determined by the engine rotation speed NE. Further, the flow rate ratio of the coolant flowing through each of the device passage 15, the heater passage 16, and the radiator passage 17 is determined by the valve phase θ of the coolant control valve 14. Thus, the radiator flow rate Frad can be calculated from the engine rotation speed NE and the valve phase θ of the coolant control valve 14.

Even when the flow rate of coolant discharged from the mechanical water pump 26 is varied by the engine rotation speed NE, the valve phase θ of the coolant control valve 14 at which the radiator flow rate Frad becomes equal to the specified flow rate α is hardly changed because the specified flow rate α is an extremely small value. Thus, the determination of whether or not the radiator flow rate Frad is greater than or equal to the specified flow rate α can be based only on the valve phase θ of the coolant control valve 14.

Figure 3:
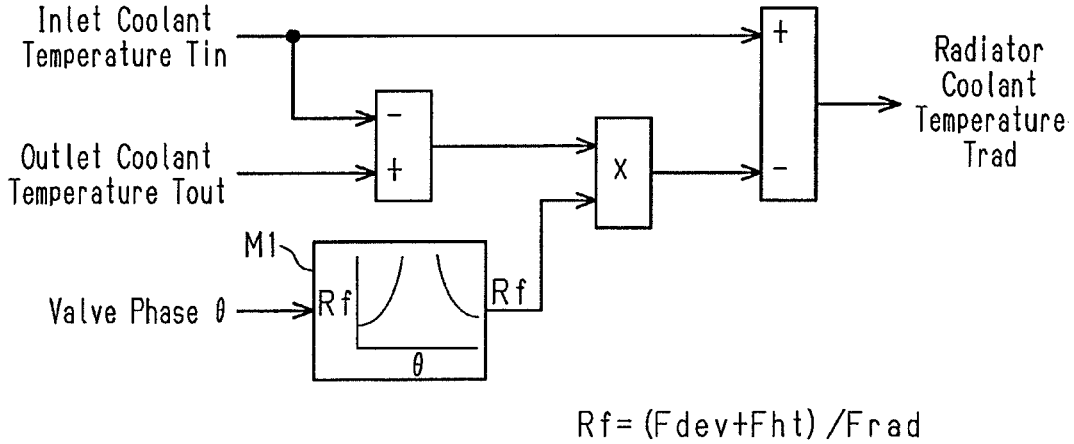
FIG. 3 is a block diagram illustrating a radiator coolant temperature estimation process executed by a coolant temperature estimator arranged in the engine cooling apparatus of FIG. 1 when a radiator port is open.

FIG. 3 is a block diagram illustrating an estimation process of the radiator coolant temperature Trad when the radiator port is open. The coolant temperature estimator 30 repeatedly executes this estimation process in specified calculation cycles as long as it determines that the radiator port is open.

Specifically, in the estimation process, the coolant temperature estimator 30 first calculates a flow rate ratio Rf. The value of the flow rate ratio Rf represents the quotient obtained by dividing the sum (second passage flow rate Fsec) of the flow rate of the coolant flowing through the device passage 15 (device flow rate Fdev) and the flow rate of the coolant flowing through the heater passage 16 (heater flow rate Fht) by the radiator flow rate (Frad). That is, when the three passages of the coolant circuit 13 are categorized into the first passage (radiator passage 17), which extends through the radiator 24, and the second passage (device passage 15, heater passage 16), which does not extend through the radiator 24, the flow rate ratio Rf represents the flow rate ratio of the coolant flowing through the second passage to that of the first passage. In the engine cooling apparatus of the present embodiment, the valve phase θ of the coolant control valve 14 determines the ratio of the coolant flow rate flowing through each of the passages 15 to 17, and consequently, the flow rate ratio Rf. Accordingly, the coolant temperature estimator 30 uses a calculation map M1 to obtain the flow rate ratio Rf from the valve phase θ. The calculation map M1 indicates the relationship between the valve phase θ, which is obtained in advance through experiments or the like, and the flow rate ratio Rf.

Subsequently, the coolant temperature estimator 30 calculates the product obtained by multiplying the difference (Tout−Tin), which is obtained by subtracting the inlet coolant temperature Tin from the outlet coolant temperature Tout by the flow rate ratio Rf. The coolant temperature estimator 30 uses the difference obtained by subtracting the product from the inlet coolant temperature Tin as an estimated value of the radiator coolant temperature Trad.

In the estimation process of the radiator coolant temperature Trad when the radiator port is open, the coolant temperature estimator 30 calculates the radiator coolant temperature Trad from equation (3).

$$Trad = Tin - (Tout - Tin) \times Rf \qquad \text{Equation 3}$$

$$= Tin - (Tout - Tin) \times \frac{Fdev + Fht}{Frad}$$

The relationship of equation (3) is satisfied when a temperature of the coolant flowing into the merging point 25 from the device passage 15 and the heater passage 16 (second passage coolant temperature Tsec) is equal to the outlet coolant temperature Tout. In this regard, after the engine 10 is warmed up, decreases in the temperature of the coolant flowing through the device passage 15 are limited. Further, the radiator 24 has a heat exchange capability that is significantly higher than the heater core 22. Thus, decreases in the coolant temperature are limited in the device passage 15 and the heater passage 16 in comparison with the radiator passage 17. Accordingly, even when the second passage coolant temperature Tsec is used as the outlet coolant temperature Tout in equation (3), the radiator coolant temperature Trad can be calculated with sufficient accuracy.

Figure 4:
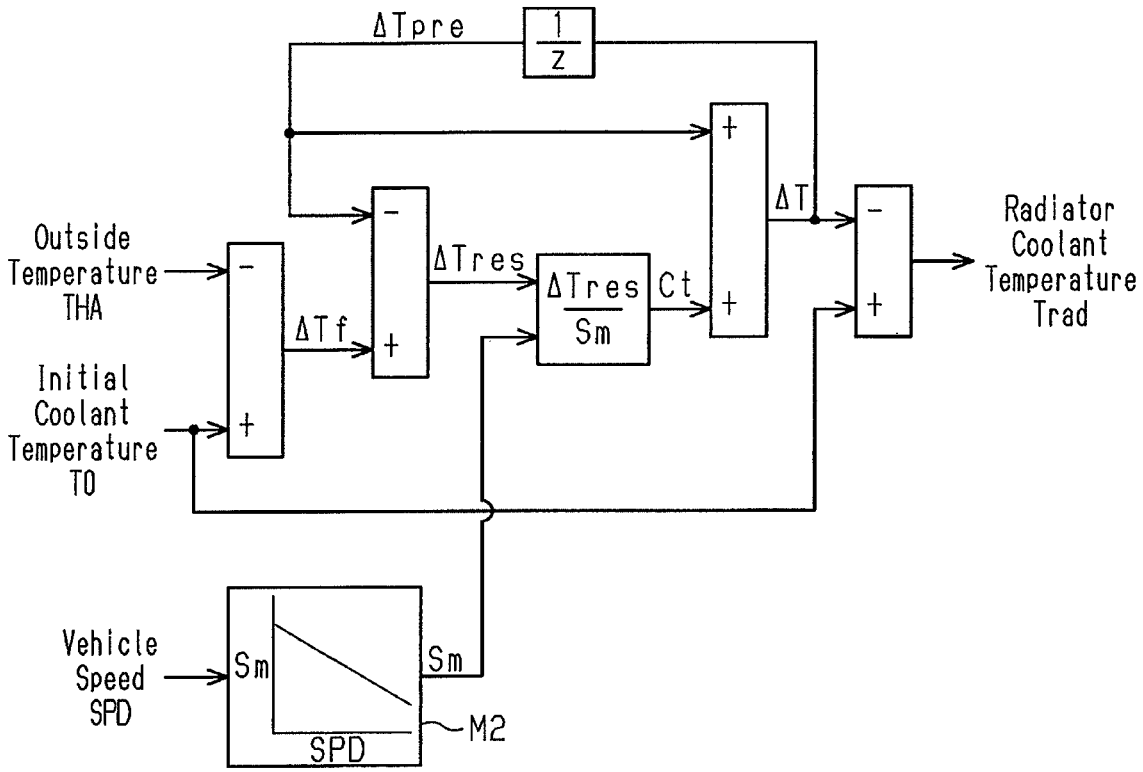
FIG. 4 is a block diagram illustrating a radiator coolant temperature estimation process executed by the coolant temperature estimator of FIG. 1 when the radiator port is closed.

FIG. 4 is a block diagram illustrating an estimation process of the radiator coolant temperature Trad when the radiator port is closed. The coolant temperature estimator 30 repeatedly executes this estimation process in specified calculation cycles as long as the coolant temperature estimator 30 determines that the radiator port is closed.

In the description hereafter, a timing when the radiator flow rate Frad becomes less than the specified flow rate α and the coolant temperature estimator 30 thus switches the estimation process of the radiator coolant temperature Trad from the process used when the radiator is open to the one used when the radiator is closed will be referred to as when the radiator port begins to close. Prior to when the radiator port begins to close, the coolant temperature estimator 30 stores the value of the radiator coolant temperature Trad calculated in the estimation process that was executed last as a value of an initial coolant temperature T0.

In this estimation process, the coolant temperature estimator 30 calculates the radiator coolant temperature Trad as a value that varies with a first-order lag element from the initial coolant temperature T0 to the outside temperature THA in accordance with the time elapsed from when the radiator port begins to close. When calculating the radiator coolant temperature Trad in the estimation process, the coolant temperature estimator 30 sets the value of the time constant of the first-order lag element to decrease as the velocity of the air current blown against the radiator 24 increases. When an electric fan or the like is not forcibly blowing air toward the radiator 24, the vehicle speed SPD determines the velocity of the air current blown against the radiator 24. Accordingly, in the present embodiment, the time constant of the first-order lag element is set based on the vehicle speed SPD.

Specifically, in the estimation process, the coolant temperature estimator 30 first calculates a value of a convergence coolant temperature difference ΔTf that is the difference obtained by subtracting the outside temperature THA from the initial coolant temperature T0. Then, the coolant temperature estimator 30 calculates a value of a residual coolant temperature difference ΔTres that is the difference obtained by subtracting the preceding coolant temperature difference ΔTpre from the convergence coolant temperature difference ΔTf. The preceding coolant temperature difference ΔTpre represents a value of a present coolant temperature difference ΔT calculated in the preceding calculation cycle of the estimation process. Further, the present coolant temperature difference ΔT represents the difference obtained by subtracting the present radiator coolant temperature Trad from the initial coolant temperature T0. That is, the present coolant temperature difference ΔT represents the amount of change in the radiator coolant temperature Trad from when the radiator port begins to close to the present point in time. Thus, the value of the residual coolant temperature difference ΔTres, which is calculated as the difference obtained by subtracting the preceding coolant temperature difference ΔTpre from the convergence coolant temperature difference ΔTf, represents the difference between the radiator coolant temperature Trad obtained in the preceding calculation cycle and the present outside temperature THA.

Subsequently, the coolant temperature estimator 30 calculates a value of a coolant temperature change amount Ct that is the quotient obtained by dividing the residual coolant temperature difference ΔTres by the time constant Sm. The coolant temperature estimator 30 uses the difference obtained by subtracting the sum of the preceding coolant temperature difference ΔTpre and the coolant temperature change amount Ct from the initial coolant temperature T0 as the value of the radiator coolant temperature Trad.

The coolant temperature estimator 30 in the estimation process uses a calculation map M2, which indicates the relationship between the vehicle speed SPD and the time constant Sm, to obtain the value of the time constant Sm from the vehicle speed SPD. In the calculation map M2, when the time constant Sm is in a value range that is greater than one, the value of the time constant Sm is set to decrease as the vehicle speed SPD increases.

Figure 5:
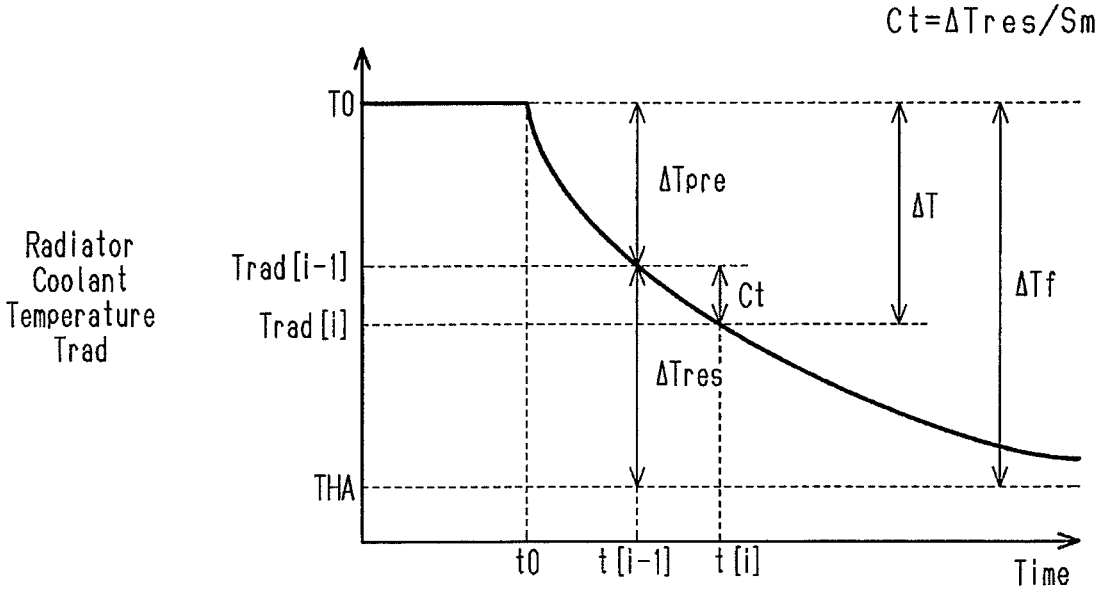
FIG. 5 is a diagram illustrating a calculation mode of the radiator coolant temperature during the radiator coolant temperature estimation process when the radiator port is closed as shown in FIG. 4.

FIG. 5 illustrates the relationship of the parameters used in the calculation for the estimation process, where time t0 indicates the time when the radiator port begins to close, time t[i−1] indicates the time of the preceding calculation cycle, time t[i] indicates the time of the present calculation cycle, Trad[i−1] indicates the value of the radiator coolant temperature Trad calculated in the preceding calculation cycle, and Trad[i] indicates the value of the radiator coolant temperature Trad calculated in the present calculation cycle. When the outside temperature THA and the vehicle speed SPD are constant, the value of the radiator coolant temperature Trad calculated in the estimation process varies with the first-order lag element from the initial coolant temperature T0 to the outside temperature THA in accordance with the time elapsed from time t0, which is when the radiator port begins to close. Further, in the estimation process, the time constant Sm of the first-order lag element is set to a small value when the vehicle speed SPD is high. Thus, the value of the radiator coolant temperature Trad is calculated to converge to the outside temperature THA further quickly.

When the coolant is hardly moving inside and outside the radiator 24, the radiator coolant temperature Trad approaches the outside temperature THA as time elapses. As the difference between the radiator coolant temperature Trad and the outside temperature THA increases, or the velocity of the air current blown against the radiator 24 increases when the vehicle speed SPD is high, the radiator coolant temperature Trad varies faster toward the outside temperature THA. In the estimation process, the radiator coolant temperature Trad is calculated to reflect the influence of the outside temperature THA and the vehicle speed SPD on changes in the radiator coolant temperature. Trad.

Immediately after switching from the estimation process executed when the radiator port is closed to the estimation process executed when the radiator port is open, an estimation error resulting from the switching may cause the value of the radiator coolant temperature Trad to vary in a stepwise manner, that is, the value of the radiator coolant temperature Trad may change in a discontinuous manner. Accordingly, in the present embodiment, a graduation control is performed on the calculated value of the radiator coolant temperature Trad immediately after switching from the estimation process executed when the radiator port is closed to the estimation process executed when the radiator port is open so that a discontinuous change does not occur in the calculated value of the radiator coolant temperature Trad.

Control of Coolant Control Valve

In the engine cooling apparatus of the present embodiment, the estimation result of radiator coolant temperature Trad estimated by the coolant temperature estimator 30 is reflected on the control of the coolant control valve 14 executed by the CCV controller 31. The process for controlling the coolant control valve 14 with the CCV controller 31 (CCV control process) will now be described in detail.

Figure 6:
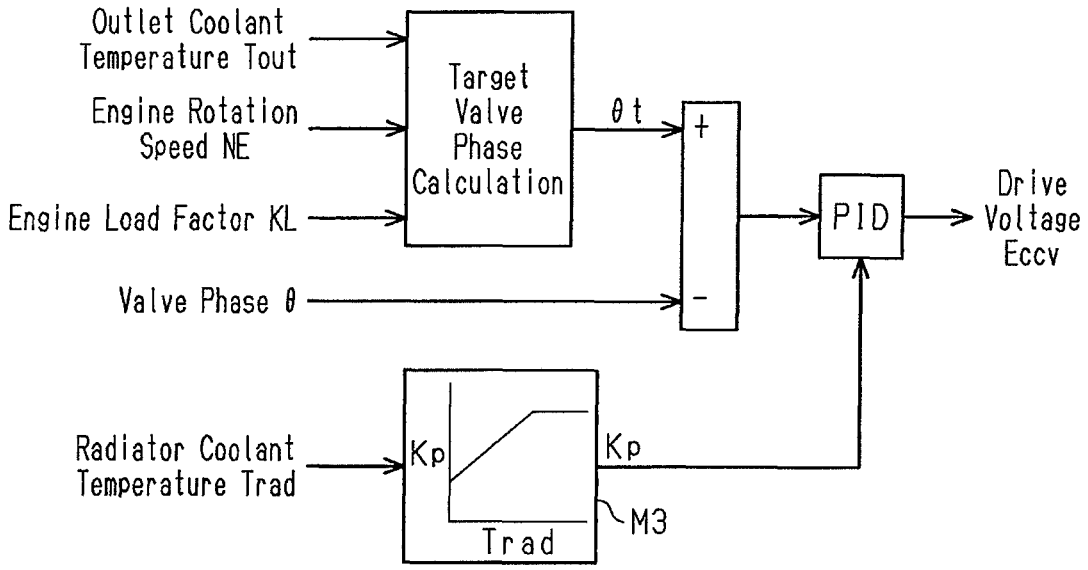
FIG. 6 is a block diagram illustrating a CCV control process executed by a CCV controller that is arranged in the engine cooling apparatus of FIG. 1.

FIG. 6 is a block diagram illustrating the CCV control process executed by the CCV controller 31. The CCV controller 31 repeatedly executes this estimation process in specified control cycles while the engine 10 is running.

In the estimation process, the CCV controller first sets a target valve phase θt that is a target value of the valve phase θ of the coolant control valve 14. The target valve phase θt is set through modes that differ before and after the engine 10 is warmed up. In the present embodiment, it is determined that the engine 10 has been warmed up when the outlet coolant temperature Tout reaches a specified engine warm-up completion temperature T2 after the engine 10 has been started.

The target valve phase θt before the engine 10 is warmed up is, as described below, set in accordance with the outlet coolant temperature Tout. When the outlet coolant temperature Tout is lower than a specified coolant flow-stopped temperature T1 (<engine warm-up completion temperature T2), the target valve phase θt is set to the position where the valve phase θ is 0° and the opening rate is "0%" for all three discharge ports, namely, the device port, heater port, and the radiator port. This blocks the coolant flowing out of the engine 10 and easily raises the temperature of the cylinder wall. When the outlet coolant temperature Tout becomes higher than the coolant flow-stopped temperature T1, the target valve phase θt is increased to the positive side or the negative side as the outlet coolant temperature Tout rises. In this regard, when the outside temperature THA is less than or equal to a reference temperature and the heater is likely to be used, the target valve phase θt is increased to the positive side. When the outside temperature THA is higher than the reference temperature and the heater is unlikely to be used, the target valve phase θt is increased to the negative side. In this case, the target valve phase θt is increased to a valve phase that is positioned immediately before the radiator port begins to open when the outlet coolant temperature Tout reaches the engine warm-up completion temperature T2.

After the engine 10 is warmed up, the CCV controller 31 starts a coolant temperature control to perform feedback control so that the outlet coolant temperature Tout becomes equal to a target coolant temperature. The target temperature is set in accordance with the driving state of the engine 10. The coolant temperature control determines the target valve phase θt. When the engine 10 is running in a condition in which knocking easily occurs, the target coolant temperature is set to be low to reduce knocking. When the engine 10 is running in a condition in which knocking is unlikely to occur, the target coolant temperature is set to be high to decrease the viscosity of the lubricating oil and improves fuel efficiency. Subsequently, the target valve phase θt is set in accordance with the deviation of the outlet coolant temperature Tout from the target coolant temperature. Specifically, in the coolant temperature control, when the outlet coolant temperature Tout is higher than the target coolant temperature, the target valve phase θt is gradually varied to increase the opening rate of the radiator port. When the outlet coolant temperature Tout is lower than the target coolant temperature, the target valve phase θt is gradually varied to decrease the opening rate of the radiator port.

The CCV controller 31 performs feedback control on the drive voltage Eccv of the coolant control valve 14 in accordance with the deviation Δθ (=θt−θ) of the present valve phase θ from the target valve phase θt. In the present embodiment, the feedback control on the drive voltage Eccv is performed through proportional-integral-differential (PID) control. More specifically, a command value of the drive voltage Eccv is calculated as the sum of three terms that are a proportional term, ah integral term, and a derivative term. The proportional term is the product obtained by multiplying the deviation Δθ by a proportional gain Kp. The integral term is the product obtained by multiplying the time-integral value of the deviation Δθ by an integral gain Ki. The derivative term is the product obtained by multiplying the time-derivative value of the deviation Δθ by a derivative gain Kd.

In the present embodiment, the values of the integral gain Ki and the derivative gain Kd in the PID control are constants. In contrast, the value of the proportional gain Kp is set to be a variable value that varies in accordance with the estimated value of the radiator coolant temperature Trad. More specifically, the CCV controller 31 sets the proportional gain Kp to a smaller value as the radiator coolant temperature Trad, which is calculated by the coolant temperature estimator 30, decreases. In the present embodiment, the CCV controller 31 uses a calculation map M3, which indicates the relationship between the radiator coolant temperature Trad and the proportional gain Kp, to obtain a value set as the proportional gain Kp. In the calculation map M3, when the radiator coolant temperature Trad is higher than or equal to a predetermined temperature, the proportional gain Kp is set to be a constant value. As the radiator coolant temperature Trad decreases from the predetermined temperature, the value of the proportional gain Kp is set to gradually decrease from the constant value. In this way, when the radiator coolant temperature Trad is low, an actuation speed of the coolant control valve 14, more specifically, a response speed of the valve phase θ of the coolant control valve 14 with respect to the target valve phase θt, is set to be lower than that when the radiator coolant temperature Trad is high. Thus, when the radiator coolant temperature Trad calculated by the coolant temperature estimator 30 is low, the actuation speed of the coolant control valve 14 increasing the coolant flow rate in the first passage, that is, the response speed of the valve phase θ of the coolant control valve 14 with respect to the target valve phase θt, is lower than that when the radiator coolant temperature Trad is high.

Advantages

Advantages of the present embodiment will now be described.

In the engine cooling apparatus of the present embodiment, when the coolant temperature control performed after the engine 10 is warmed up sets the target coolant temperature to a temperature that is significantly higher than the outlet coolant temperature Tout, the radiator flow rate Frad becomes zero or an extremely small value. In this state, the coolant inside and outside the radiator 24 may hardly be moving. If the outside temperature THA is low in such a state, the coolant remaining in the radiator 24 is cooled by the outside air. Thus, the temperature of the coolant circulating through the coolant circuit 13 greatly differs from the coolant temperature in the radiator 24.

Under such a situation, when the radiator flow rate Frad is rapidly increased, coolant enters through the radiator 24. The temperature of the coolant entering the radiator 24 is higher than the temperature of the coolant in the radiator 24. Thus, the high-temperature coolant entering the radiator 24 may cause thermal strain and reduce the durability of the radiator 24. Further, after the radiator flow rate Frad is rapidly increased, the cold coolant remaining in the radiator 24 and flowing into the engine 10 may lower the outlet coolant temperature Tout. In this case, the outlet coolant temperature Tout is temporarily decreased until the coolant in the radiator 24 is replaced by the high-temperature coolant entering the radiator 24. This may adversely affect the controllability of the coolant temperature control.

In this respect, the engine cooling apparatus of the present embodiment can accurately calculate the radiator coolant temperature Trad through the estimation process executed by the coolant temperature estimator 30 without directly measuring the temperature. Further, the CCV controller 31 controls the coolant control valve 14 so that the actuation speed of the coolant control valve 14 is lower when the estimated radiator coolant temperature Trad is low than that when the radiator coolant temperature Trad is high. Thus, when the radiator coolant temperature Trad is low, changes in the radiator flow rate Frad are limited. This reduces thermal strain and maintains the controllability of the coolant temperature control.

As described above, in the present embodiment, the estimation of the radiator coolant temperature Trad when the radiator port is open is based on the presumption that the temperature of the coolant flowing into the merging point 25 from the device passage 15 and the heater passage 16 (second passage coolant temperature Tsec) is equal to the outlet coolant temperature Tout. This presumption is satisfied after the engine 10 is warmed up but may not be satisfied during a cold start of the engine 10. During a cold start, the temperature is low in the throttle valve 18 and the like, through which the coolant in the device passage 15 flows.

In this respect, in the present embodiment, when the outlet coolant temperature Tout is lower than the coolant flow-stopped temperature T1, the flow of coolant is stopped in each of the device passage 15, the heater passage 16, and the radiator passage 17. When the outlet coolant temperature Tout is higher than or equal to the coolant flow-stopped temperature T1 and less than the engine warm-up completion temperature T2, the coolant flows only through the device passage 15 and the heater passage 16. The coolant begins to flow through the radiator passage 17 only when the outlet coolant temperature Tout becomes higher than or equal to the engine warm-up completion temperature T2. That is, in the present embodiment, when the coolant begins to circulate through the coolant circuit 13, the coolant sequentially flows in order of the second passage (device passage 15, heater passage 16) and then, after a delay, the coolant flows in the first passage (radiator passage 17). Accordingly, when the radiator port is open, the radiator coolant temperature Trad is correctly estimated through equation (3) from when the estimation is first performed after the engine 10 is started.

The present embodiment can be modified as described below.

In the present embodiment, the radiator coolant temperature Trad estimated by the coolant temperature estimator 30 is reflected on the control of the coolant control valve 14. The radiator coolant temperature Trad may be reflected on other controls. For example, if an electric fan is arranged in an engine cooling apparatus to blow air toward the radiator 24, the estimated value of the radiator coolant temperature Trad can be reflected on the control of the electric fan. The electric fan is typically actuated in a state in which the inlet coolant temperature Tin is high. Even under a condition in which the electric fan would be actuated, if the radiator coolant temperature Trad were to be low, there would be no need to actuate the electric fan in order to limit increases in the inlet coolant temperature Tin. Thus, control can be executed to restrict actuation of the electric fan when the radiator coolant temperature Trad is low to reduce unnecessary electricity consumption.

In the engine cooling apparatus of the present embodiment, the second passage, which allows coolant to flow without passing through the radiator 24, is arranged parallel to the first passage (radiator passage 17), which allows coolant to flow through the radiator 24. Further, the second passage includes two passages, namely, the device passage 15 and the heater passage 16. As long as the coolant in the second passage does not flow through the radiator 24, the second passage can also be formed by one passage, which is arranged parallel to the first passage, or by three or more passages.

In the present embodiment, when the radiator coolant temperature Trad is low, the CCV controller 31 lowers the actuation speed of the coolant control valve 14 to increase the radiator flow rate Frad. When the radiator coolant temperature Trad is low, the CCV controller 31 also lowers the actuation speed of the coolant control valve 14 to decrease the radiator flow rate Frad. In this regard, the actuation speed of the coolant control valve 14 may be changed in accordance with the radiator coolant temperature Trad only when the CCV controller 31 increases the radiator flow rate Frad. This will also limit rapid increases in the radiator flow rate Frad in a state in which the radiator coolant temperature Trad is low. Thus, thermal strain will be reduced in the radiator 24 without adversely affecting the controllability of the coolant temperature control.

In the present embodiment, the vehicle speed SPD is used as an index value for the velocity of the air current blown against the radiator 24 to set the value of the time constant Sm. In an engine cooling apparatus that includes an electric fan to blow air toward the radiator 24, the actuation state of the electric fan also changes the velocity of the air current. Thus, it is preferable that the actuation state of the electric fan, in addition to the vehicle speed SPD, be taken into account when setting the value of the time constant Sm. For example, even when the vehicle speed SPD is the same, if the time constant Sm is set based on the vehicle speed SPD and whether or not the electric fan is actuated, the value of the time constant Sm will be smaller when the electric fan is actuated than when the electric fan is de-actuated. In this way, the velocity of the air current blown against the radiator 24 will be higher when the electric fan is actuated than when the electric fan is de-actuated. This allows the radiator coolant temperature Trad to be estimated taking into account that the radiator coolant temperature Trad decreases more quickly when the electric fan is actuated.

The electronic control unit 29 does not have to include a central calculation processing unit and a memory to process each process described above with software. For example, the electronic control unit 29 can include exclusive hardware (application specific integrated circuit: ASIC) to execute at least some of the processes. More specifically, the electronic control unit 29 can be a circuit that includes 1) more than one exclusive hardware circuit such as an ASIC, 2) more than one processor (microcomputer) that runs on a computer program (software), or 3) a combination of the above.

The invention claimed is:

1. An engine cooling apparatus comprising:

a coolant circuit that recirculates coolant that has passed through an engine back to the engine, wherein the coolant circuit includes a first passage, which allows coolant to flow through a radiator, and a second passage, which allows coolant to flow without passing through the radiator, arranged parallel to the first passage;

a coolant control valve that varies a ratio of a first passage flow rate, which is a flow rate of the coolant flowing through the first passage, and a second passage flow rate, which is a flow rate of the coolant flowing through the second passage;

an outlet coolant temperature sensor that detects an outlet coolant temperature, which is a temperature of the coolant before the coolant reaches a branching point of the first passage and the second passage in the coolant circuit;

an inlet coolant temperature sensor that detects an inlet coolant temperature, which is a temperature of the coolant after the coolant has passed through a merging point of the first passage and the second passage in the coolant circuit; and a coolant temperature estimator that calculates a radiator coolant temperature when the first passage flow rate is greater than or equal to a specified flow rate, wherein the radiator coolant temperature is a temperature of the coolant at a coolant exit of the radiator, and the radiator coolant temperature relative to the first passage flow rate, the second passage flow rate, the outlet coolant temperature, and the inlet coolant temperature satisfies a relationship expressed by an equation of $$Trad = Tin - (Tout - Tin) \times \frac{Fsec}{Frad}$$

where Trad represents the radiator coolant temperature, Frad represents the first passage flow rate, Fsec represents the second passage flow rate, Tout represents the outlet coolant temperature, and Tin represents the inlet coolant temperature.

2. The engine cooling apparatus according to claim 1, wherein when a value of the radiator coolant temperature Trad calculated immediately before the first passage flow rate Frad becomes less than the specified flow rate is an initial coolant temperature, based on the initial temperature and outside temperature, the coolant temperature estimator calculates the radiator coolant temperature Trad when the first passage flow rate Frad is less than the specified flow rate as a value that varies with a first-order lag element from the initial coolant temperature to the outside temperature in accordance with time elapsed from when the first passage flow rate Frad becomes less than the specified flow rate, and the coolant temperature estimator sets a time constant of the first-order lag element to a smaller value when a velocity of air current blown against the radiator is a first velocity than when the velocity is a second velocity that is lower than the first velocity.

3. The engine cooling apparatus according to claim 2, wherein the time constant is set based on a speed of a vehicle, in which the engine is installed, to be a smaller value when the speed is a first speed than when the speed is a second speed that is lower than the first speed.

4. The engine cooling apparatus according to claim 1, further comprising a controller that controls actuation of the coolant control valve, wherein when increasing the flow rate of the coolant flowing through the first passage, the controller sets an actuation speed of the coolant control valve to be lower when the radiator coolant temperature Trad estimated by the coolant temperature estimator is a first radiator coolant temperature than when the radiator coolant temperature Trad is a second coolant temperature that is higher than the first coolant temperature.

5. The engine cooling apparatus according to claim 1, wherein when initiating circulation of coolant through the coolant circuit after the engine is started, the coolant control valve is configured to initiate coolant flow sequentially in order of the second passage and then, after a delay, the first passage.

* * * * *